United States Patent [19]

Schmucker et al.

[11] 4,279,399

[45] Jul. 21, 1981

[54] CONCRETE BEAM MOLDING APPARATUS

[75] Inventors: Erwin Schmucker, Schelklingen; Karl Rampf, Erbach, both of Fed. Rep. of Germany

[73] Assignee: Rampf KG Formen GmbH & Co., Allmendingen, Fed. Rep. of Germany

[21] Appl. No.: 114,439

[22] Filed: Jan. 22, 1980

[30] Foreign Application Priority Data

Feb. 1, 1979 [DE] Fed. Rep. of Germany ..... 2903755

[51] Int. Cl.[3] ..... E01C 19/50

[52] U.S. Cl. ..... 249/2; 249/50; 249/170; 249/185

[58] Field of Search ..... 249/2, 23, 24, 29, 50, 249/82, 170, 185

[56] References Cited

U.S. PATENT DOCUMENTS

| | | | |
|---|---|---|---|
| 1,470,673 | 10/1923 | Amborsen | 249/50 |
| 3,092,886 | 6/1963 | Dykeman et al. | 249/50 |
| 3,132,403 | 5/1964 | Richards et al. | 249/50 |
| 3,168,771 | 2/1965 | Nelson | 249/50 |
| 4,055,321 | 10/1977 | Schimmel | 249/185 |
| 4,118,004 | 10/1978 | Scott | 249/50 |

*Primary Examiner*—Donald E. Czaja
*Assistant Examiner*—W. Thompson
*Attorney, Agent, or Firm*—George R. Douglas, Jr.

[57] ABSTRACT

A cast concrete form work apparatus for constructing bridge beams in which form work partitions 5, 6 and 10, 11 having work surfaces 6, 12 are tangentially adjoined by a tube member 1 and adjustable apparatus is provided to hold in a fixed angular relation two work partitions by use of a clamping bar 13 and clamp screw 14 extending through a slot 16 together with a groove member 2, 3, 4 having a seal 21. Complementary constructions assembled as a pivotal arrangement provide a form work for constructing bridge beams with an upper surface disposed for use as inclined roadway.

5 Claims, 3 Drawing Figures

CONCRETE BEAM MOLDING APPARATUS

BRIEF SUMMARY OF THE INVENTION

The invention relates to a cast concrete form, especially for bridge beams and having two shuttering partitions for forming a fillet at the finished concrete part, being pivotally assembled to each other and thus subject selectively to form various angles.

The possibility of varying the inclination of the shuttering partitions is desirable, e.g. for the production of bridge beams with T-shaped sections, because a bridge with a curved roadway must have an inclination between the transversal flange and the center flange according to the roadway inclination.

BACKGROUND OF THE INVENTION

Known shuttering partition hinges are made like ordinary hinges, having a continuous axle to which both shuttering partitions are connected by means of ears or sleeves, and may resemble a piano hinge, whereby the connecting means assigned to each shuttering partition alternate along the axial direction. It further is known to cover the connecting means of those hinges with a cover having a circular shape.

In an ideal case the enfiladed connecting means form a cylindrical outer surface to which applies, without a gap, the inner surface of the cover. In practice the groove is made from sheet metal and often is distorted and has a more or less important distance to the connecting means. It therefore casts itself into the hollow moulding of the concrete part and creates an ugly step. Furthermore, when vibrating concrete penetrates between the connecting means and the cover which becomes even more distorted when removing the form. Therefore the known concrete form hinges need continuous maintenance and repair and nevertheless the finished concrete parts are not satisfactory.

SUMMARY OF THE INVENTION

The invention is based on the problem to avoid these difficulties and provide a structure to propose an articulated concrete form economically producing maintenance free form works and producing faultless casts.

According to an object of the present invention the problem is solved by constructing a concrete form as described above in that a tube is attached to one shuttering partition and a groove 2, 3, 4 receiving a partial section of the tube 1 is fitted to the other shuttering partition in such a way that the shuttering surfaces tangentially join the outside of the tube such as at bearing surface 15 and edge 19, and that a clamping bar connected to the groove by means of screws 14 is arranged axially in the tube holding it in tension against the groove so that the screws each pass radially through a circumferential slot 16 in the tube. Such a hinge can be made from common shapes and therefore is cheap. The hollow moulding of the finished concrete part is not produced by a sheet metal cover as in known hinges, but by a tube, having a much higher rigidity and being the axis of the articulation increases considerably and favorably the bending resistance of the hinge. Furthermore the groove dimensioned for extending longitudinally contributes to the rigidity.

The groove does not need to be a perfect half of a female cylinder. It is sufficient to produce a U-shaped cross-section from rectangular bars or to use a common channel. Only the walls of the groove, called hereafter supporting bars, shall have a female cylindrical bearing surface, corresponding to the outer shape of the tube, on which the tube is bearing. In order to avoid visible steps in the hollow moulding of the concrete part it further is proposed that an outer surface of the groove being level with the shuttering surface extends tangentially to the tube and forms a sharp edge with the adjoining bearing surface. This edge does not show itself in the concrete part and, when moving the articulation, it is able to remove residual concrete left over on the outside of the tube from a preceding casting operation.

A seal 21 extending longitudinally in the groove and being made from an appropriate sealing material, laying against the tube reduces the danger of penetration of concrete into the interior of the articulation thus keeping it movable over a long period of time.

While the tube preferably is welded to the corresponding shuttering partition or to the shuttering partitions reinforcement, the groove may be screwed to the other shuttering partition. In this case the fastening screws alternate longitudinally with the screws connecting the clamping bar to the groove.

Normally shuttering partitions are covered with the so-called shuttering planks being in contact with the concrete. In order to connect these shuttering planks to the articulation without joints, it is advantageous to weld to the tube a longitudinal bar, the outer surface of which extends tangentially to the tube provided with a profile in which the shuttering planks can be introduced with a corresponding profile on their edge thus being secured against the danger being pulled off at the joint. Similarly the groove may have such a profile at the edge of its tangential surface.

BRIEF DESCRIPTION OF THE SEVERAL VIEWS OF THE DRAWINGS

The above and other objects and advantages of the invention will become apparent upon full consideration of the following detailed description and accompanying drawings in which.

DETAILED DESCRIPTION OF THE PREFERRED EMBODIMENT OF THE INVENTION

Figure 1:
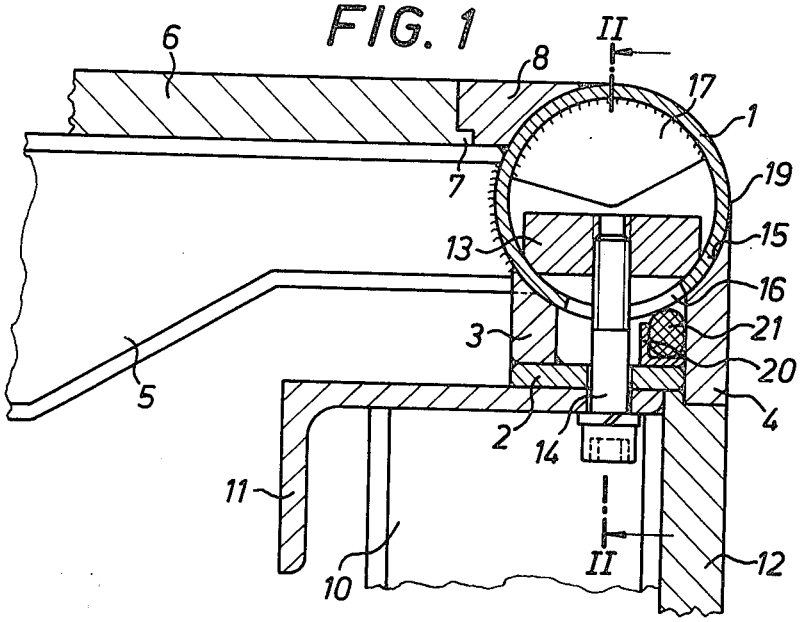
FIG. 1 is a cross-sectional view of a shuttering hinge or form work apparatus according to the preferred embodiment of the invention.
Figure 2:
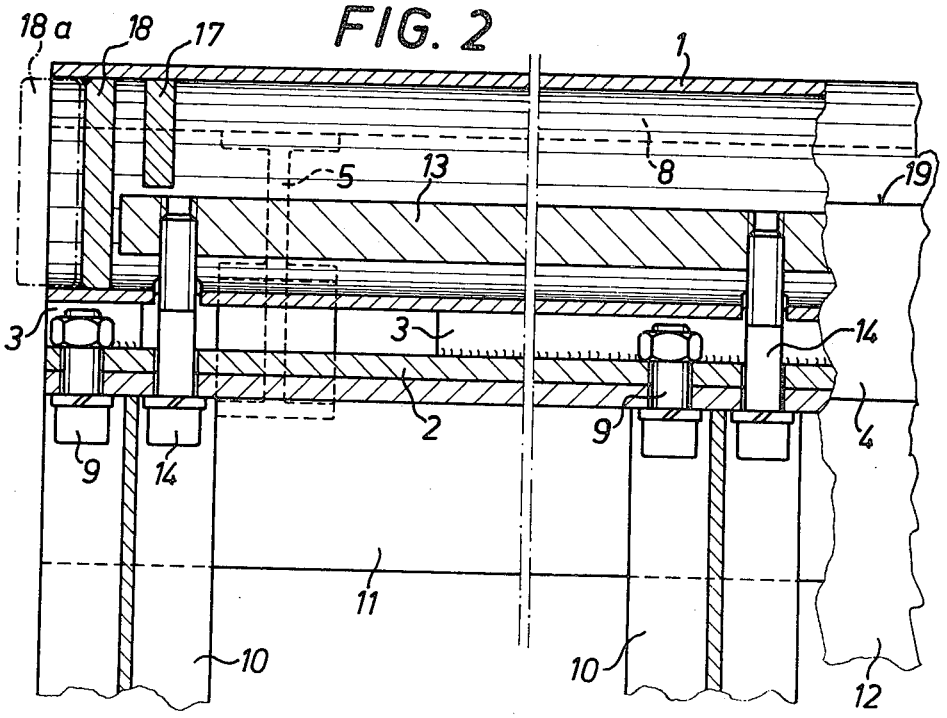
FIG. 2 is a longitudinal section taken along line II—II of this hinge.

Referring now to the drawings there is shown a shuttering hinge according to FIGS. 1 and 2 comprised of a hollow tube 1 and three rectangular bars 2, 3, 4 welded together in a U-shaped arrangement forming a channel or groove. Herein one rectangular bar is a bottom 2 and the two others are the side and supporting bars 3 and 4. One of the partitions being represented approximately horizontally in the drawing, is comprised of an I-beam 5 and a plank or shuttering cover 6 being introduced with a tongue 7 underneath a corresponding recessed step of a bar 8 and in which the upper work surface thereof is level with the surface of the shuttering cover which joins tangentially with the tube 1 to which it may be welded.

The bottom 2 of the groove is affixed by means of short fastening screws 9, 9 to the front side of a vertical shuttering partition and the I-beam 10 is welded to angles 11 where they meet as shown. The supporting bar 4 and its work surface protrudes downwardly underneath the bottom 2 of the groove and is provided with a recess or step into which is introduced an extension or tongue of a form work plank or shuttering cover 12 affixed to the I-beams 10.

In order to secure tube 1 in the groove there is provided a clamping bar 13 extending throughout the total length of tube 1 which is pulled against the groove and the angle 11 by means of clamp screws 14, 14. The supporting edges of the clamping bar 13 are rounded and bearing surfaces 15 of the supporting bars 2, 3, 4 are curved cylindrically corresponding to the outer shape of the tube. The clamp screws 14 pass through circumferential slots 16 in the tube 1 allowing the tube with the adjoining shuttering partition to rotate in the groove when the clamp screws 14 are loosened. Circular sector discs 17 are welded into the tube at each end serving as angular stops being in contact with the clamping bar 13 when occasion arises. Eventually tube 1 is closed at both ends by cover discs 18 shown in FIG. 2 for protecting it against penetration of dirt and maintaining the clamping bar 13 in its longitudinal position when the clamp screws 14, 14 are unscrewed for taking apart the articulation or arrangement. When using several concrete forms in succession or alignment then a cylindrical adapter 18*a* may be placed into adjacent ends of two adjacent tubes 1 for alignment.

The supporting bar 3 is interrupted or foreshortened longitudinally as shown to allow the I-beam 5 to pivot sufficiently. The edge 19 formed by the bearing surface 15 and the outer face of the supporting bar 4 lays in contact against tube 1. As an additional precaution against the penetration of concrete therein a continuous seal 21 is arranged in the groove as shown and is maintained in place by an angle member 20.

Figure 3:
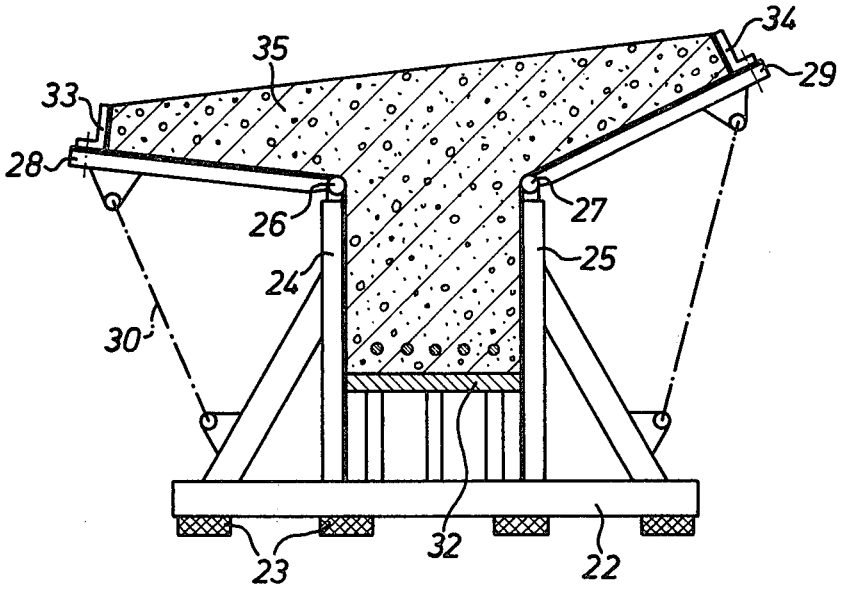
FIG. 3 is a schematic cross-sectional view of a concrete form for bridge beams having two such hinges and being illustratively represented at a smaller scale.

The concrete form work apparatus according to FIG. 3 is comprised of a base structure 22 mounted on a truck base or sitting on rubber-bonded-to-metal feet 23, 23. The vertical forms or shuttering partitions 24 and 25 are braced laterally as shown and the partitions are connected by means of horizontal hinges 26 and 27 to forms or shuttering partitions 28 and 29 which may be pivoted approximately 10° above and 30° below a horizontal line. In order to do this length-adjustable braces 30 and 31 as shown in fantom are adjusted accordingly. The form work is completed by installing an adjustable shuttering bottom 32 by installing put-on side-boards 33 and 34 as shown. The represented bridge formed beam 35 is designed for a bridge beam with an upper surface disposed for use as an inclined roadway.

Additional embodiments of the invention in this specification will occur to others and therefore it is intended that the scope of the invention be limited only by the appended claims and not by the embodiments described hereinabove. Accordingly, reference should be made to the following claims in determining the full scope of the invention.

What is claimed is:

1. A cast concrete form work apparatus for constructing bridge beams with an upper surface disposed for use as an inclined roadway comprising a generally vertically disposed form work partition and having a work surface, a hollow tube rotatably adjoined tangentially to an upper edge of said work surface of the vertically disposed partition, a second form work partition having a work surface securely affixed to the tube on a side thereof distal to the upper edge of the vertically disposed partition and extending in selective various angles to the horizontal for forming a pivotal assembly to each other, a groove member affixed onto a back side of the work surface and adjacent to the upper edge of the vertically disposed partition and having upper surfaces of the groove member being contoured for mating with an extension surface of the tube, the tube being hollow for receiving a clamping bar, a circumferentially disposed slot in the tube surface adjacent the groove member, and securing means passing radially through the circumferential slot between the vertically disposed form work partition and the clamping bar for locking the tube into a fixed position therewith and forming a rounded fillet for a finished concrete structure by means of the pivotal assembly.

2. A cast concrete form work apparatus as set forth in claim 1 wherein said groove member has a hollow cylindrical bearing surface mating with the tube corresponding to the outer shape of the tube and the working surface of said member groove being co-planar with the shuttering surface extending tangentially to the tube for forming a sharp edge with the adjoining bearing surface.

3. A cast concrete form work apparatus as set forth in claim 2 wherein a longitudinal seal disposed within the groove member lays against the tube.

4. A cast concrete form work apparatus as set forth in claim 2 wherein a longitudinal bar having an outer work surface extending tangentially of the tube and the groove member with its work surface tangential to the tube surface receives shuttering planks profiled in coplanar relation accordingly.

5. A cast concrete form work apparatus as set forth in claim 1 wherein a complementary set of two of the pivotal assemblies form are provided with an adjustable shuttering bottom having form work surface and distal edges of the second form work partition have put-on side-boards that provide a bridge beam with an upper surface disposed when concrete hardens in place for use as an inclined roadway.

* * * * *